US008859479B2

(12) United States Patent
Stratton

(10) Patent No.: US 8,859,479 B2
(45) Date of Patent: Oct. 14, 2014

(54) CHEMICAL STRIPPING COMPOSITION AND METHOD

(75) Inventor: Eric W. Stratton, Mansfield, TX (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/218,754

(22) Filed: Aug. 26, 2011

(65) Prior Publication Data

US 2013/0053292 A1 Feb. 28, 2013

(51) Int. Cl.

| | |
|---|---|
| ***C11D 7/04*** | (2006.01) |
| ***C11D 7/08*** | (2006.01) |
| ***C11D 1/00*** | (2006.01) |
| ***C23F 1/44*** | (2006.01) |

(52) U.S. Cl.

CPC ..... *C23F 1/44* (2013.01); *F05B 2230/101* (2013.01); *F05B 2230/80* (2013.01)

USPC ..... 510/253; 510/254; 510/269; 510/467; 510/499

(58) Field of Classification Search

CPC ..... C11D 1/00; C11D 3/042; C11D 3/046; C11D 7/08; C11D 7/10

USPC ..... 510/253, 254, 269, 467, 499

See application file for complete search history.

(56) References Cited

U.S. PATENT DOCUMENTS

| | | | | |
|---|---|---|---|---|
| 2,564,549 | A | 8/1951 | Stargardter | |
| 2,940,837 | A | 6/1960 | Acker et al. | |
| 4,339,282 | A | 7/1982 | Lada et al. | |
| 4,346,128 | A | 8/1982 | Loch | |
| 4,460,479 | A | 7/1984 | Mulder | |
| 4,919,752 | A | 4/1990 | Mika | |
| 4,944,807 | A | 7/1990 | Sova | |
| 5,182,006 | A | 1/1993 | Haydu et al. | |
| 5,417,955 | A | 5/1995 | Connolly | |
| 5,512,201 | A * | 4/1996 | Singh et al. | 252/79.4 |
| 5,630,950 | A | 5/1997 | Cangelosi | |
| 5,720,823 | A | 2/1998 | Carlson et al. | |
| 6,554,908 | B1 * | 4/2003 | Negri et al. | 134/3 |
| 6,660,102 | B2 | 12/2003 | Jeutter et al. | |
| 6,932,898 | B2 | 8/2005 | Kryzman et al. | |
| 6,955,308 | B2 | 10/2005 | Segrest et al. | |
| 7,008,522 | B2 | 3/2006 | Boucard et al. | |
| 7,008,553 | B2 | 3/2006 | Wustman et al. | |
| 7,033,466 | B2 | 4/2006 | Riewe | |
| 7,935,642 | B2 | 5/2011 | Kool et al. | |

FOREIGN PATENT DOCUMENTS

| | | |
|---|---|---|
| EP | 0713957 A1 | 5/1996 |
| EP | 0769574 A1 | 4/1997 |
| EP | 0769575 A1 | 4/1997 |

OTHER PUBLICATIONS

European Search Report, mailed Sep. 6, 2012.

* cited by examiner

*Primary Examiner* — Gregory R Delcotto

(74) *Attorney, Agent, or Firm* — Kinney & Lange, P.A.

(57) ABSTRACT

A stripping solution comprises a highly corrosive acid and an iron concentration of at least about 1.0 gram per liter (g/L). The stripping solution is air agitated to remove a coating from a metal article submerged therein.

17 Claims, 2 Drawing Sheets

CHEMICAL STRIPPING COMPOSITION AND METHOD

BACKGROUND

The invention relates generally to chemical compositions, and more specifically to chemical compositions and methods for stripping coatings from metal articles.

Traditionally, metal articles, including operative parts as well as tooling, are stripped, etched, and cleaned with a standard corrosive solution consisting of an acid such as a high molarity hydrochloric acid (HCl), sulfuric ($H_2SO_4$), or nitric acid ($HNO_3$), or mixtures thereof. Depending on the application and the coating, the acid may be supplemented with a wetting agent to dissociate the acid molecules to increase their effectiveness at removing coating or other molecules diffused into the metal substrate. The solution is otherwise substantially free of contaminants, such as iron. Once coating contamination of the solution exceeds a threshold concentration, the solution is discarded and/or recycled.

In many instances, the acid is not selective between the coating or contaminant and the metal substrate, particularly when the part has been previously run in a hot engine. The acid continues to attack the metal substrate, causing pitting or other surface damage that must be repaired. If significant, such damage can result in scrapping of the part. In addition, pure corrosive acids do not completely remove certain coatings, and the parts must be subsequently exposed to a mechanical desmutting process. Further, the stripping and desmutting process using a pure acid solution often needs to be repeated two or more times before the coating is completely removed from the substrate.

SUMMARY

A stripping solution comprises a highly corrosive acid and an iron concentration of at least about 1.0 gram per liter (g/L).

A method of making a solution for stripping a coating from a metal article comprises adding a highly corrosive acid to a vessel, increasing an iron concentration of the highly corrosive acid to at least about 1.0 gram per liter (g/L); and agitating the solution.

A method for removing a coating from a metal article comprises maintaining a stripping solution in a first temperature range, submerging the metal article in the stripping solution, and air agitating the solution containing the submerged article. The stripping solution comprises a highly corrosive acid, and has an iron concentration of at least about 1.0 gram per liter (g/L).

DETAILED DESCRIPTION

Figure 1:
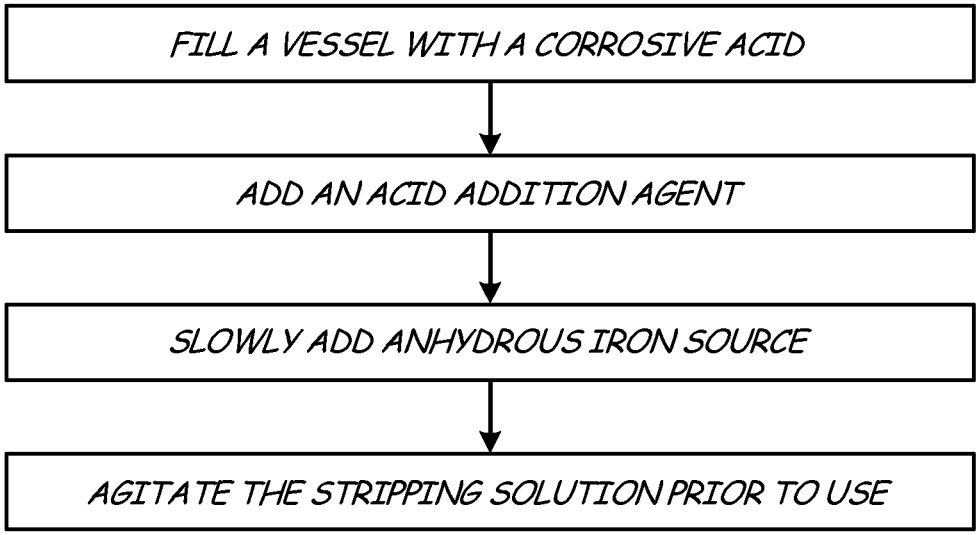
FIG. 1 is a flow chart of a process for making the stripping solution.

FIG. 1 shows the steps for making a coating stripping solution, which includes (1) filling an appropriate acid-resistant vessel with a corrosive acid to a normal operating level; (2) optionally adding an acid addition agent to the acid; (3) slowly adding an anhydrous iron source to the acid; and (4) agitating the stripping solution prior to use.

Some coating compounds form strong bonds internally and with the substrate to make both resistant to chemical, mechanical, and/or thermal attack. Tooling for manufacturing parts can be coated, as well as being exposed to contaminants, but must retain its shape to ensure repeatable results. It may be that the coating has been damaged or that the coating breaks down over time. In such cases, the old coating(s) must be stripped off to produce a clean, like-new substrate surface to prepare the part for reapplication. Similarly, tooling used to hold and/or form parts during fabrication (via casting, forging, machining, etc.) will need to undergo periodic cleaning and refurbishing with oxides, residual coatings, substrate material from processed parts, as well as other contaminants being removed from the operative surfaces.

One industry employing a substantial amount of both tooling and specially coated components is the aerospace industry. For example, components of gas turbine engines used on aircraft must withstand high temperatures, pressures, along with chemical and mechanical attack. There are abrasive coatings, abradable coatings, thermal barrier coatings, and bond coatings, among others.

Occasionally these coatings must be removed and reapplied due to damage or wear. Coatings and other surface contamination from processing have previously been removed by one or more chemical, thermal, and mechanical means. The most common chemical method to remove coatings from metal substrates is using a pure corrosive acid solution. These acids typically included one or more of a combination of certain corrosive acids such as hydrochloric (HCl), sulfuric ($H_2SO_4$), and nitric ($HNO_3$) substantially free of contaminants or other constituent elements such as iron. A wetting, or acid addition agent is sometimes added to dissociate the acid molecules in solution. Certain compositions, used for etching new superalloy parts prior to coating for the first time, contain large amounts of iron (more than about 15%) dissolved in an acid. This composition, however, is effective only for surface preparation of clean blades or other nickel-base superalloy parts. The reaction pathway for the etching solution is relatively complex compared to the redox pathway described below. Further, the 15% iron concentration has not been shown to be significantly more effective at removing coatings from superalloy substrates, as compared to a relatively pure corrosive acid solution with little or no iron content.

Parts and tooling stripped using pure or nearly pure acid-based solutions require mechanical desmutting processes such as grit blasting to completely remove the residual chemically modified coating material as well. In many cases, with such solutions, the process of stripping and desmutting must be repeated several times to remove most traces of the previous coating. Further, the likelihood of pitting can be increased as an artifact of the engine-run conditioning during normal operation. Thus once a relatively pure acid solution is used to strip such parts, they also require surface repair to remove pitting and other damage caused by the acid attacking the compromised substrate during the stripping process.

Traditionally, operational components were handled separately from the tooling used to form and process those parts. Separate cleaning and coating removal baths were used and intermingling of the two mixtures was limited (i.e. separate acid baths were provided for tooling and for operational parts). At small concentrations, less than about 100 ppm (100 mg/L), iron has been treated as a contaminant and was not believed to materially increase the rate or degree of coating attack by the acid. Maintaining separate baths was also thought to prevent cross-contamination of superalloy parts by the residual tooling contamination, particularly with respect to contaminating superalloys requiring very low iron compositions. To this end, many vendors specify that iron concentration of stripping solutions used to remove coatings from their parts is minimized. In most cases the specified maximum is significantly less than 100 ppm.

However, it was found quite by accident that increasing the iron concentration of a highly corrosive acid to at least about 1.0 g/L can accelerate many coating attack reactions as compared to a relatively pure acid bath. As described below, combinations of concentration and processing conditions can also reduce or eliminate mechanical desmutting. In certain embodiments, a stripping solution comprising a strong acid and a weight-to-volume concentration range of iron between about 1.0 g/L and about 10.0 g/L can be used to remove coatings and/or other contaminants from metal substrates. In certain of those embodiments, a stripping solution comprising a strong acid and a weight-to-volume concentration range of iron between about 3.0 g/L and about 8.0 g/L can be used. In yet certain of those embodiments, a stripping solution comprising a strong acid and a weight-to-volume concentration range of iron between about 5.5 g/L and about 6.5 g/L can be used. In certain of the above embodiments, a wetting agent can optionally be added to any of the above stripping solutions to dissociate the acid and further facilitate the coating attack reaction. The wetting agent can be any known to be compatible with the selected acid(s). One example is a proprietary formula sold under the trade designation Actane® AAA.

With regard to the steps shown in FIG. 1, the highly corrosive acid can be any available technical or reagent grade acid available from numerous industrial chemical suppliers. In one example, the acid is selected from the group of hydrochloric (HCl), sulfuric ($H_2SO_4$), nitric ($HNO_3$), hydrofluoric (HF), phosphoric ($H_3PO_4$), and combinations thereof. The concentration (molarity) of the selected acid is selected based on the required stripping time, reactivity with the iron species used to increase the coating removal effectiveness, as well as effectiveness for a particular coating and substrate combination. Examples of one solution effective for a number of coatings and substrates are described below. Concentration of the optional acid addition agent is determined based on vendor instructions and is typically the minimum required for effectiveness and to extend the useful life of the stripping solution.

The anhydrous source of iron can also be a reagent obtained from a chemical supply vendor, or can be sourced elsewhere. Regardless of its source, water is not to be added to the solution in any form (including as a hydrate of the iron source) due to the risk of a violent reaction with the strong acid that could result in splashing and boiling over the vessel In certain embodiments, the anhydrous source of iron is selected from the group of: ferric chloride ($FeCl_3$), ferrous chloride ($FeCl_2$), ferric sulfate ($Fe_2(SO_4)_3$), and ferrous sulfate ($FeSO_4$), or combinations thereof. In certain of those embodiments, the anion from the iron source, and the acid anion are identical. (e.g., $FeCl_3$ or $FeCl_2$ or a combination thereof is used with HCl, ($Fe_2(SO_4)_3$ or $FeSO_4$ or a combination is used with $H_2SO_4$, etc.) In some cases, mechanical agitation is sufficient to mix the stripping solution prior to submerging the coated metal article. In other cases, air agitation can be used as described below. Mechanical agitators are well known in the art, as well as the process of bubbling air through a solution to facilitate mixing.

Note above that the iron concentration can be increased by either a ferric ($Fe^{3+}$) or a ferrous ($Fe^{2+}$) source. This is believed to be a result of an oxidation reaction that converts the ferrous ions into ferric ions. An example reduction-oxidation reaction using HCl to convert ferrous chloride ($FeCl_2$) to ferric chloride ($FeCl_2$).

$$O_2+2(FeCl_2)+4HCl <=> 2FeCl_3+2H_2O+Cl_2 \quad [1]$$

As seen in Equation 1, the reaction proceeds in both directions with the solution always trending toward a thermodynamic equilibrium between the two sides. To thermodynamically push this reaction to the right and to maintain the coating removal reaction with sufficient ferric ion levels, sufficient oxygen ($O_2$) can be dissolved in the solution such as from air agitation. Gases with higher oxygen concentrations than a standard atmosphere can be used as well but with an attendant increased risk of an accidental unwanted reaction.

As will be described later, the ferric ($Fe^{3+}$) ions (corresponding to $FeCl_3$ or other ferric source described above) is believed to be an oxidizing agent for the bonds between the coating and the metal substrate. The ferric ions are thus reduced during the coating removal reaction into ferrous ($Fe^{2+}$) ions (corresponding to $FeCl_2$). As seen in FIGS. 3A-3D below, the dissolved oxygen available at the beginning of the mixing process will usually be insufficient to complete the entire coating removal process. Thus air agitation can be used to help the stripping solution maintain the coating removal reaction.

Thus, oxygen ($O_2$) can be dissolved in the solution via agitation both during mixing and later during the stripping process. It will be appreciated that air agitation can provide far more dissolved oxygen than mechanical agitation and can constantly replenish that which is consumed during the mixing reaction. And because it is believed that the ferric ions actually cause the reduction-oxidation reaction in the coating removal reaction, continued air agitation will further increase the rate of the coating removal reaction when the article is submerged by maintaining a sufficient concentration of ferric ($Fe^{3+}$) ions.

As seen above, byproducts of the above oxidation reaction includes water ($H_2O$) and chlorine gas ($Cl_2$), both of which at least partially escape into the surrounding environment during mixing and processing. It should be noted that while the above reaction utilizes HCl and $FeCl_2$, similar oxidation of ferrous ions into ferric ions will occur with alternative acids and alternative ferrous sources.

An example process and composition for a stripping solution follows. The example solution contains about 6.0 g/L $Fe^{3+}$ dissolved in 12M HCl and is made as follows: (1) filling a vessel with about 85 gallons (about 320 L) reagent grade 12 M (moles/L) HCl (37 wt %) to a suitable safe operating level; (2) adding between about 2 mL and about 5 mL of acid addition agent Actane® AAA; (3) slowly adding about 9.0 pounds (about 4.1 kg) of anhydrous ferric chloride ($FeCl_3$) to the tank; (4) air agitating the solution for at least one hour prior to using. As noted above, water in any form (including hydrates) is not to be added to the HCl solution.

It should be noted that if anhydrous ferrous chloride is used in lieu of ferric chloride, the total mass of the anhydrous iron source can be reduced. This is because a given mass of ferrous chloride contains more moles of iron per unit mass than does ferric chloride. In the above example, therefore, to achieve a concentration of about 6.0 g/L $Fe^{3+}$, the appropriate amount of ferrous chloride ($FeCl_2$) is about 7.0 lbs (about 3.2 kg).

In addition to adjusting the iron concentration of an acid solution by adding the chemical reagants described above, iron concentration can also be increased merely through prior use of the relatively pure acid as a solution for cleaning steel tooling. Iron, and thus the ferrous and ferric ions discussed above, can be introduced to the solution at least in part by reusing a stripping solution from a steel tooling bath. As the tooling is cleaned by a relatively pure acid solution, a substantial amount of iron oxide with other ferrous and ferric ions dissolved in the solution. As was previously mentioned, tooling had traditionally been processed separately from the actual operative parts in different vessels to minimize cross-contamination. However, when the iron concentration reaches the above-described levels, the used tooling bath can be used to quickly and efficiently strip coatings from other metal articles as well. If the used tooling bath does not reach the appropriate iron concentration through tool cleaning alone, suitable amounts of iron reagent(s) can be added to increase the concentration. Similarly, if the iron concentration is too high, corresponding amounts of acid can be added to reduce iron levels to the desired range. It was also discovered that the increased iron content also accelerated the removal of contaminants and other material from the tooling itself until it reached the upper limits of the concentration range described above.

Figure 2:
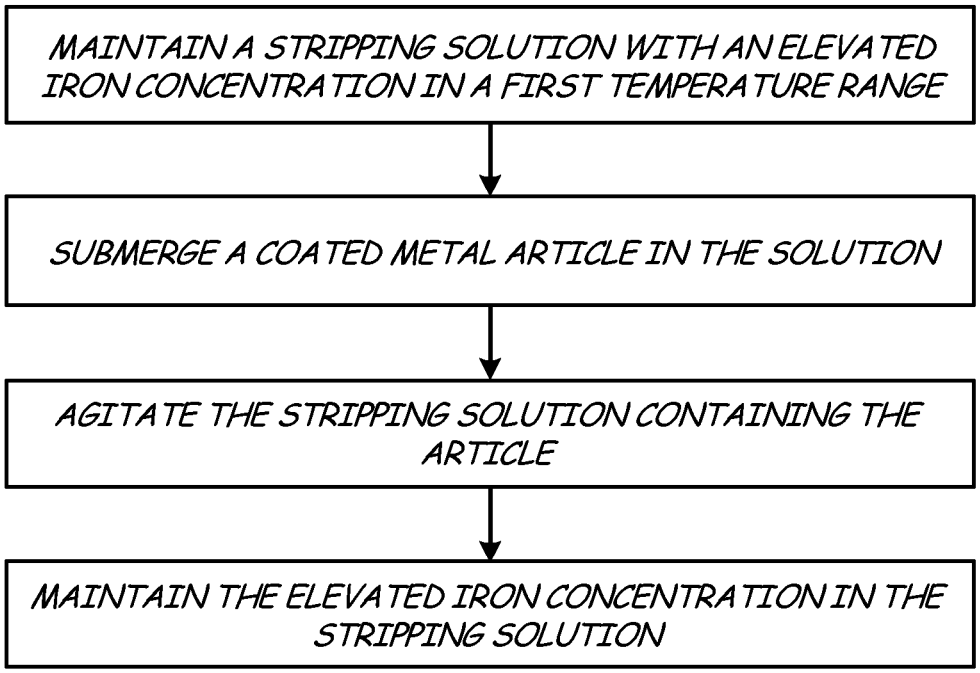
FIG. 2 is a flow chart of a process for using the stripping solution.
Figure 3A:
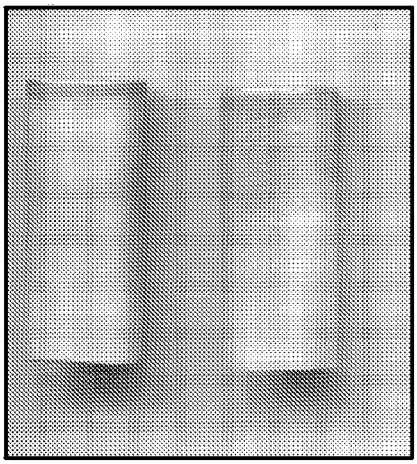
FIG. 3A is a photograph of a test part processed in a mechanically agitated acid bath with no added iron.
Figure 3B:
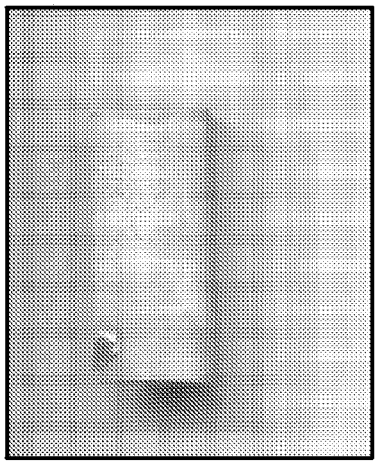
FIG. 3B is a photograph of a test part processed in an air agitated acid bath with no added iron.
Figure 3C:
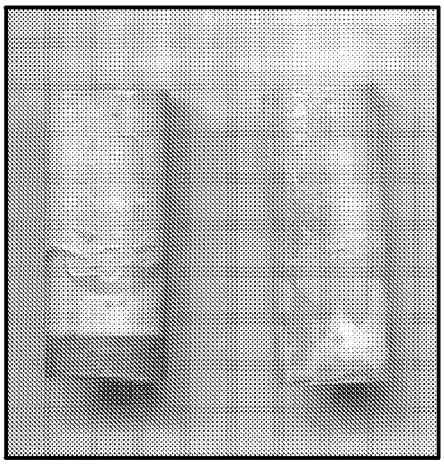
FIG. 3C is a photograph of a test part processed in a mechanically agitated stripping solution having a 6.0 g/L iron concentration.
Figure 3D:
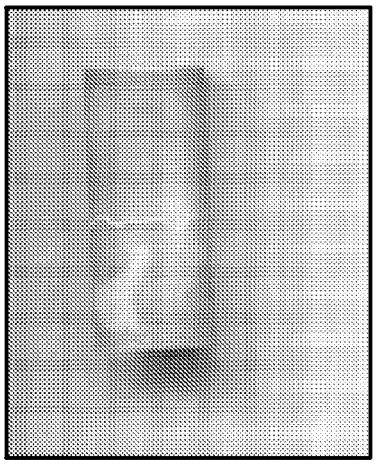
FIG. 3D is a photograph of a test part processed in an air agitated stripping solution having a 6.0 g/L iron concentration.

FIG. 2 shows a generalized process for stripping a coated metal article as follows: (1) maintaining a stripping solution with an elevated iron concentration in a first temperature range; (2) submerging the coated metal article into the stripping solution; (3) air agitating the stripping solution containing the article; and (4) optionally maintaining the elevated iron concentration in the stripping solution.

The elevated iron concentration for the process depicted in FIG. 2 is at least about 1.0 g/L. In certain embodiments, the iron concentration is between about 1.0 g/L and about 10.0 g/L. In certain of those embodiments, the first iron concentration is between about 3.0 g/L and about 8.0 g/L. In yet certain of those embodiments, the first iron concentration is between about 5.5 g/L and about 6.5 g/L. In certain of the above embodiments, the stripping solution comprises a highly corrosive acid selected from the group of: hydrochloric (HCl), sulfuric ($H_2SO_4$), nitric ($HNO_3$), hydrofluoric (HF), and phosphoric ($H_3PO_4$) acids, or mixtures thereof. The stripping solution with the first iron concentration can be produced by the example methods described with respect to FIG. 1 or by any other suitable process.

The first temperature range can be optimized for each particular iron concentration, coating, and substrate combination. For example, certain MCrAlY coated nickel-base superalloys like PWA 1484 are submerged with the first temperature being between about 140° F. and about 160° F. The stripping time in this example is about 2 hours. As tank level drops with usage, the iron concentration increases. Additional quantities of acid can be provided between stripping runs to maintain a suitable operating level and pH. Makeup quantities of anhydrous iron can also be added in the event that concentrations drop below a suitable level.

The above solution can be used to remove an MCrAlY bond coating from a nickel-base PWA 1484 superalloy substrate. The example process utilizes a 12 M HCl stripping solution with an iron concentration ranging between about 5.5 g/L and about 6.5 g/L, and containing acid addition agent Actane® AAA. The process includes the steps of: (1) maintaining the stripping solution at a temperature between about 140° F. and about 160° F.; (2) submerging an MCrAlY coated PWA 1484 superalloy article in the stripping solution; (3) while maintaining the temperature of the solution, air agitating the solution for about 2 hours; and (4) optionally adding makeup hydrochloric acid and/or anhydrous ferric chloride to the vessel during the stripping process to maintain the iron concentration.

As noted above, while stripping the coating, air is bubbled through the stripping solution to agitate the solution. This maintains a sufficient level of ferric ions to continue oxidizing the coating molecules out of the substrate. In all but the most extreme cases, when used with air agitation and a sufficient iron concentration, this process will not require mechanical de-smutting to remove reacted coating and other contamination from the article. With a few exceptions, such as very thick coating or a high concentration of dissolved coating material or other contamination (such as from performing several removal processes with the same bath), the coating attack is substantially complete merely from air agitating the stripping solution having an elevated iron concentration.

The coating attack reaction is believed to be a cyclic reduction/oxidation reaction between the ferric ions and the metal bonds in the coating and between the coating and the metal substrate. The working hypothesis is that the high concentration of ferric ions in the solution help the acid to oxidize the metal-metal and metal-oxide bonds holding the diffused coating molecules to the substrate. In a mechanically agitated bath, the coating removal rate slows over time, while the air agitated bath continues removing coating material at a relatively constant rate. The slowing of the mechanically agitated bath is consistent with eventual depletion of the ferric ions due to the reduction reaction, leaving an increased concentration of ferrous ions having a significantly lower oxidation potential. With oxygen being continuously reintroduced by air agitation, the ferrous ions are replenished back into a ferric state, continuing oxidation of the coating to completion. Further, if the solution is air agitated prior to submerging the article to be stripped, it maximizes the available quantity of ferric ions in solution due to the extra time to fully oxidize any ferrous ions. (See Equation 1). Additional makeup reagants and heat can be provided as the reaction proceeds in order to maintain the vessel at a suitable condition to continue the stripping reaction. Notably, using the stripping solution according to the above process substantially prevents surface attack and pitting.

While the above example is described with respect to stripping an MCrAlY bond coating from PWA 1484 substrate, similar elevated iron solutions and processing conditions have been shown effective for many other substrates and coatings. The solution and accompanying process are effective more generally for nickel-base superalloys, as well as titanium alloy and steel substrates. Similarly, effective removal has been seen with a variety of MCrAlY type coatings as well as aluminides, platinides, and platinum aluminides.

Four examples follow that illustrate the results of tests on various stripping solutions and processes. Glass-lined steel tanks were each filled with about 250 mL of reagent grade (12 M) HCl to normal operating level. Approximately 1 μL of acid addition inhibitor Actane® AAA was added to each. All four examples below were performed using coupons of a solution heat-treated PWA 1484 nickel-base superalloy with an MCrAlY coating. Photographs of the coupons taken after the tests are shown in FIGS. 3A-3D.

EXAMPLE 1

No Iron, Mechanical Agitation

Two tanks were mechanically agitated to mix the acid and inhibitor for at least one hour prior to using. No iron was added to the acid solutions. Tank heater control was set to maintain the baths between about 140° F. and about 160° F. After coming to temperature, one coupon was then placed in each bath as mechanical agitation and heat continued for another two hours. The mechanically agitated baths resulted in virtually no coating attack on the two coupons, shown in FIG. 3A by the relatively uniform dulled gray surfaces consistent with MCrAlY coatings.

EXAMPLE 2

No Iron, Air Agitation

The tanks were agitated with air bubbled through the solution to mix the acid and inhibitor for at least one hour prior to using. No iron was added to the acid solutions. Tank heater control was set to maintain the baths between about 140° F. and about 160° F. After coming to temperature, the coupons were submerged as air agitation and heat continued for another two hours. The air agitated iron-free baths resulted in limited coating attack on the coupons, shown by the spotted surfaces in FIG. 3B.

EXAMPLE 3

6 g/L $Fe^{3+}$, Mechanical Agitation

Approximately 340 mg of ferric chloride ($FeCl_3$) was added to one of the tanks, and mechanically agitated for one hour prior to heating. Tank heater control was set to maintain the baths between about 140° F. and about 160° F. After coming to temperature, one coupon was placed in the bath as agitation and heat continued for another two hours. The mechanically agitated bath resulted in moderate coating attack, more so than the iron-free air agitated bath of Example 2. This can be seen comparing the dimpled surface in FIG. 3C to FIG. 3B

EXAMPLE 4

6 g/L $Fe^{3+}$, Air Agitation

Approximately 340 mg of ferric chloride ($FeCl_3$) was added to one of the tanks, and air agitated for one hour prior to heating. Tank heater control was set to maintain the bath between about 140° F. and about 160° F. After coming to temperature, one coupon was then placed in the bath as air agitation and heat continued for another two hours. The air agitated bath experienced complete coating attack which can be seen in FIG. 3D by the cleaner and relatively dimple-free surface. In addition, the coupon in the air agitated bath did not require additional mechanical cleaning or desmutting steps. It can also be seen that there was no noticeable evidence of pitting or other substrate attack.

The above example tests were repeated with similar concentrations of ferrous chloride ($FeCl_2$) in place of ferric chloride ($FeCl_3$). In the mechanically agitated tests, the ferrous chloride/HCl solution consistently resulted in slower, less complete coating attack. In the air agitated tests, the coating attack was nearly identical to the tests where ferric chloride was added to the acid solution. This is further evidence that air agitation introduced oxygen causing more of the ferrous $Fe^{2+}$ ions to oxidize into ferric $Fe^{3+}$ ions according to equation 1 prior to and during coating removal.

Currently, the used stripping solution is disposed of as hazardous waste due to its heavy metal content and corrosive properties. For this reason, adequate ventilation and protective gear is required. However, these byproducts are similar to those seen in traditional coating removal using pure acid solutions. Those with suitable chemical processing facilities can readily devise steps to recycle the solution by removing certain quantities of oxidized coating materials and contaminants.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A stripping solution consisting of:
- a highly corrosive acid solution, wherein the highly corrosive acid solution consists of hydrochloric acid (HCl) and water;
- a wetting agent;
- a quantity of iron consisting of ferrous ($Fe^{2+}$) iron and ferric ($Fe^{3+}$) iron such that the ferric ($Fe^{3+}$) iron concentration is at least about 1.0 gram per liter (g/L) and less than 10.0 g/L; and
- dissolved oxygen ($O_2$) gas.

2. The solution of claim 1, wherein a molarity of the highly corrosive acid solution is at least about 12 M (about 37 wt %).

3. The solution of claim 1, wherein the ferric ($Fe^{3+}$) iron concentration is between about 3.0 g/L and about 8.0 g/L.

4. The solution of claim 3, wherein the ferric ($Fe^{3+}$) iron concentration is between about 5.5 g/L and about 6.5 g/L.

5. A method of making a solution for stripping a coating from a metal article, the method comprising:
- adding a hydrochloric acid solution to a vessel;
- adding a wetting agent to the vessel;
- adding an iron-containing article to the vessel; and
- agitating the hydrochloric acid solution, the wetting agent, and the iron-containing article in the vessel to form a stripping solution consisting of:
  - a highly corrosive acid solution, wherein the highly corrosive acid solution consists of hydrochloric acid (HCl) and water;
  - a wetting agent;
  - a quantity of iron consisting of ferrous ($Fe^{2+}$) iron and ferric ($Fe^{3+}$) iron such that the ferric ($Fe^{3+}$) iron concentration range in the stripping solution is at least about 1.0 gram per liter (g/L), and less than 10.0 g/L;
  - dissolved oxygen ($O_2$) gas
  - reaction byproducts; and
  - incidental contaminants.

6. The method of claim 5, wherein the hydrochloric acid and water form the highly corrosive acid solution with a molarity of at least about 12 M (37 wt %).

7. The method of claim 5, wherein the iron-containing article is an anhydrous chemical reagent selected from the group consisting of: ferric chloride ($FeCl_3$), ferrous chloride ($FeCl_2$), ferric sulfate ($Fe_2(SO_4)_3$), ferrous sulfate ($FeSO_4$), and combinations thereof.

8. The method of claim 5, wherein the iron-containing article is one or more steel tooling articles submerged in the stripping solution until the ferric ($Fe^{3+}$) iron concentration of the stripping solution is at least about 1.0 g/L.

9. The method of claim 5, wherein the agitation step is performed by bubbling air through the solution.

10. The solution of claim 1, wherein the dissolved oxygen ($O_2$) gas is present in a non-equilibrium concentration sufficient to convert at least some of the ferrous ($Fe^{2+}$) iron reaction products into ferric ($Fe^{3+}$) iron, maintaining the range of ferric ($Fe^{3+}$) iron concentration in the stripping solution.

11. The method of claim 5, further comprising:

continuously agitating the stripping solution with an oxygen-containing gaseous agitating composition through the solution to maintain a non-equilibrium concentration of dissolved oxygen ($O_2$) in the stripping solution;

wherein the non-equilibrium concentration of dissolved oxygen ($O_2$) gas is sufficient to maintain the ferric ($Fe^{3+}$) iron concentration range in the stripping solution.

12. A stripping solution consisting of:

hydrochloric acid (HCl);

water;

a wetting agent;

a quantity of iron consisting of ferrous ($Fe^{2+}$) iron and ferric ($Fe^{3+}$) iron such that the ferric ($Fe^{3+}$) iron concentration is at least about 1.0 gram per liter (g/L) and less than 10.0 g/L;

dissolved oxygen ($O_2$) gas;

reaction byproducts; and incidental impurities.

13. The solution of claim 12, wherein the ferric ($Fe^{3+}$) iron concentration is between about 5.5 g/L and about 6.5 g/L.

14. The solution of claim 12, wherein the quantity of iron is derived from an anhydrous chemical reagent selected from the group of: ferric chloride ($FeCl_3$), ferrous chloride ($FeCl_2$), ferric sulfate ($Fe_2(SO_4)_3$), ferrous sulfate ($FeSO_4$), and combinations thereof.

15. The solution of claim 12, wherein the quantity of iron is derived from iron-containing reaction products stripped from one or more steel tooling articles previously submerged in a tooling bath consisting of one or more portions of: the hydrochloric acid (HCl); the water; the wetting agent; and the dissolved oxygen ($O_2$) gas.

16. The solution of claim 15, wherein the incidental reaction byproducts are byproducts from the stripped iron-containing reaction products.

17. The solution of claim 12, wherein the dissolved oxygen ($O_2$) gas is present in a non-equilibrium concentration sufficient to convert at least some of the ferrous ($Fe^{2+}$) iron reaction products into ferric ($Fe^{3+}$) iron, maintaining the range of ferric ($Fe^{3+}$) iron concentration in the stripping solution during a coating removal process.

* * * * *